US007891496B2

(12) United States Patent
Fendley

(10) Patent No.: US 7,891,496 B2
(45) Date of Patent: Feb. 22, 2011

(54) HINDERED-SETTLING FLUID CLASSIFIER

(76) Inventor: Brian K. Fendley, 155 Black Point La., Pilot Mountain, NC (US) 27041

( * ) Notice: Subject to any disclaimer, the term of this patent is extended or adjusted under 35 U.S.C. 154(b) by 0 days.

(21) Appl. No.: 12/378,011

(22) Filed: Feb. 10, 2009

(65) Prior Publication Data

US 2010/0200474 A1 Aug. 12, 2010

(51) Int. Cl.
*B03B 5/66* (2006.01)

(52) U.S. Cl. ..... 209/158; 209/162

(58) Field of Classification Search ..... 209/158, 209/160, 162, 172, 172.5, 173, 913
See application file for complete search history.

(56) References Cited

U.S. PATENT DOCUMENTS

| | | | | | |
|---|---|---|---|---|---|
| 1,451,067 | A | * | 4/1923 | Elder | 209/172.5 |
| 2,189,418 | A | * | 2/1940 | Finney | 209/18 |
| 2,468,005 | A | | 4/1949 | Walker et al. | |
| 2,491,912 | A | * | 12/1949 | Walker | 209/283 |
| 2,530,676 | A | | 11/1950 | Berg et al. | |
| 2,698,087 | A | * | 12/1954 | Tucker, Jr. | 209/158 |
| 3,249,226 | A | * | 5/1966 | Watson | 209/172.5 |
| 3,682,299 | A | * | 8/1972 | Conley et al. | 209/17 |
| 4,012,316 | A | * | 3/1977 | Ostlund et al. | 209/10 |
| 4,111,798 | A | * | 9/1978 | Peterson et al. | 209/172.5 |
| 4,165,839 | A | * | 8/1979 | Kuwajima et al. | 241/4 |
| 4,397,424 | A | | 8/1983 | Zappa et al. | |
| 4,807,761 | A | | 2/1989 | Hollingsworth | |
| 6,264,040 | B1 | | 7/2001 | Mankosa et al. | |
| 6,293,407 | B1 | * | 9/2001 | Bajema | 209/495 |
| 6,953,123 | B2 | | 10/2005 | Niitti | |
| 7,147,111 | B2 | | 12/2006 | Fendley | |
| 2010/0078363 | A1 | * | 4/2010 | Jody et al. | 209/12.1 |

* cited by examiner

*Primary Examiner*—Joseph C Rodriguez
(74) *Attorney, Agent, or Firm*—Schwartz Law Firm, P.C.

(57) ABSTRACT

A hindered-settling fluid classifier is adapted for processing material aggregate in a liquid medium. The fluid classifier includes a classifier tank defined by walls designed for holding the liquid medium, and comprising a sink fraction chamber and a float fraction chamber, and a fluid inlet and a fluid outlet. An elongated rising current column is vertically mounted within the sink fraction chamber, and adapted for extending below a surface of the liquid medium held therein. The rising current column has open upper and lower ends, and defines an aggregate entry between its upper and lower ends for receiving material aggregate into the classifier tank. A float fraction reservoir is located above the sink fraction chamber, and communicates with the open upper end of the rising current column. An overflow passage communicates with the float fraction reservoir, and is adapted for directing the liquid medium outwardly from the reservoir and into the float fraction chamber. A first conveyor removes an aggregate float fraction entrained in the liquid medium and collecting inside the float fraction chamber, while a second conveyor removes an aggregate sink fraction collecting inside the sink fraction chamber.

20 Claims, 6 Drawing Sheets

HINDERED-SETTLING FLUID CLASSIFIER

TECHNICAL FIELD AND BACKGROUND OF THE INVENTION

The present disclosure relates broadly to a hindered-settling fluid classifier applicable for processing material aggregate. The exemplary fluid classifier effectively washes and classifies raw material, such as coal, based on its specific gravity and utilizing sink-float techniques.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, the disclosure comprises a hindered-settling fluid classifier adapted for processing material aggregate in a liquid medium. The fluid classifier includes a classifier tank defined by walls designed for holding the liquid medium, and comprising a sink fraction chamber and a float fraction chamber, and a fluid inlet and a fluid outlet. An elongated rising current column is vertically mounted within the sink fraction chamber, and is adapted for extending below a surface of the liquid medium held therein. The rising current column has open upper and lower ends, and defines an aggregate entry between its upper and lower ends for receiving material aggregate into the classifier tank. A float fraction reservoir is located above the sink fraction chamber, and communicates with the open upper end of the rising current column. An overflow passage communicates with the float fraction reservoir, and is adapted for directing the liquid medium outwardly from the reservoir and into the float fraction chamber. Means are provided for removing an aggregate float fraction entrained in the liquid medium and collecting inside the float fraction chamber, and for removing an aggregate sink fraction collecting inside the sink fraction chamber.

According to another exemplary embodiment, an elevated aggregate hopper and deposit chute are adapted for gravity feeding dry material aggregate into the classifier tank through the aggregate entry formed with the rising current column. In alternative implementations of the present disclosure, the material aggregate may be fed into the classifier tank in a liquid slurry.

According to another exemplary embodiment, a flow control device is located adjacent the open lower end of the rising current column.

According to another exemplary embodiment, the flow control device comprises a series of radiating angled blades adapted for generating an upwardly whirling flow of liquid medium inside the rising current column.

According to another exemplary embodiment, the means for removing the aggregate float fraction comprises an upwardly-angled screw conveyor. Alternatively, the means may comprise any other material separating and/or conveying machine, apparatus, or structure including, for example, mechanical lifts, belts, collection screens, sieves, de-watering devices, or the like.

According to another exemplary embodiment, the means for removing the aggregate sink fraction comprises an upwardly-angled screw conveyor. Alternatively, the means may comprise any other material separating and/or conveying machine, apparatus, or structure including, for example, mechanical lifts, belts, collection screens, sieves, de-watering devices, or the like.

According to another exemplary embodiment, the fluid outlet comprises a discharge line communicating with the float fraction chamber.

According to another exemplary embodiment, the fluid inlet communicates with the sink fraction chamber.

According to another exemplary embodiment, the sink fraction chamber comprises a drain valve.

According to another exemplary embodiment, the float fraction chamber comprises a drain valve.

In yet another exemplary embodiment, the disclosure comprises a method for classifying material aggregate in a liquid medium. The method includes depositing dry material aggregate into a classifier tank of a hindered-settling fluid classifier. The classifier tank includes a sink fraction chamber and a float fraction chamber. The dry material aggregate is fed through a deposit chute and into a rising current column vertically mounted within the sink fraction chamber. An upwardly whirling flow of liquid medium is generated inside the rising current column. The liquid medium includes an entrained fraction of material aggregate. The liquid medium exiting the rising current column is directed into the float fraction chamber. An aggregate float fraction entrained in the liquid medium and collecting in the float fraction chamber is removed from the classifier tank, while the aggregate sink fraction collecting in the sink fraction chamber is removed from the classifier tank.

According to another exemplary embodiment, the step of directing the liquid medium outwardly from the rising current column includes temporarily holding the liquid medium in a float fraction reservoir prior to overflow into the float fraction chamber.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterite) is not intended to indicate or imply that the invention has been previously reduced to practice or that any testing has been performed.

Figure 1:
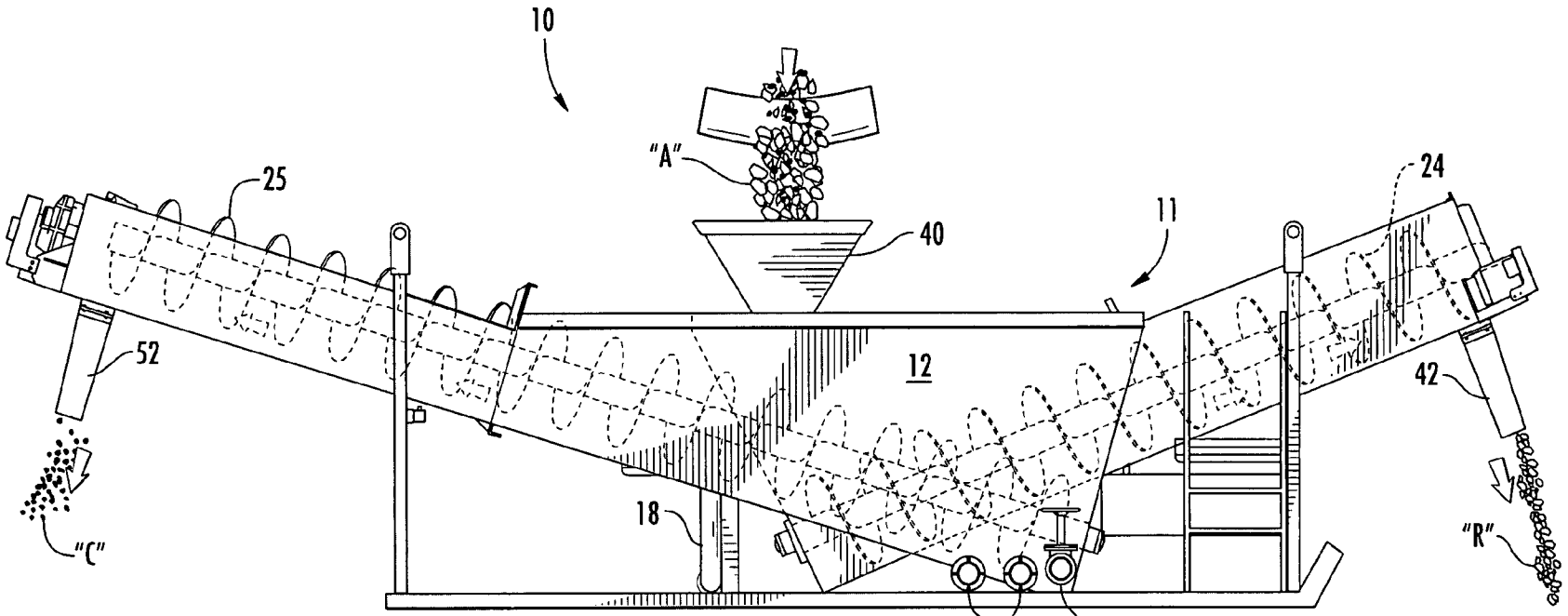
FIG. 1 is a first side elevation of a hindered-settling fluid classifier according to one exemplary embodiment of the present disclosure.

Referring now specifically to the drawings, a hindered-settling fluid classifier according to one exemplary embodiment of the present invention is illustrated in FIG. 1, and shown generally at reference numeral 10. The exemplary fluid classifier 10 utilizes sink-float techniques applicable for washing raw material aggregate "A", such as coal found in collection ponds, to separate useful fines from waste rock, such as pyrite. In one exemplary implementation, the fluid classifier 10 utilizes water having a specific gravity of approximately 1.0 as liquid medium for processing material aggregate such that the denser aggregate fraction (having a specific gravity greater than 1.0) sinks in the water, while the less dense aggregate fraction (having a specific gravity less than 1.0) floats. In other implementations, the fluid classifier 10 may use relatively heavy liquid media. In these cases, a finely ground [e.g., minus 325 mesh (0.044 mm)] heavy mineral, such as magnetite, may be mixed with water to produce a medium of the desired specific gravity to separate the coal. This medium specific gravity typically ranges between 1.3 and 1.8.

Figure 2:
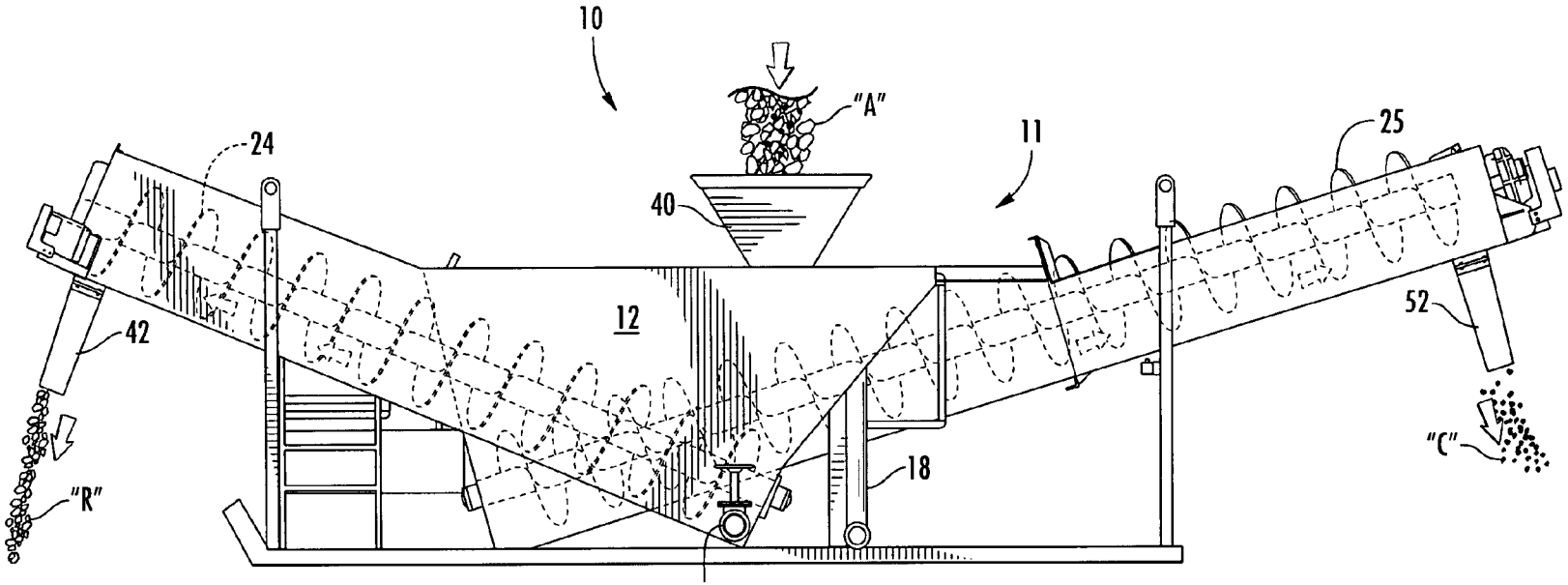
FIG. 2 is an opposite side elevation of the exemplary hindered-settling fluid classifier.
Figure 3:
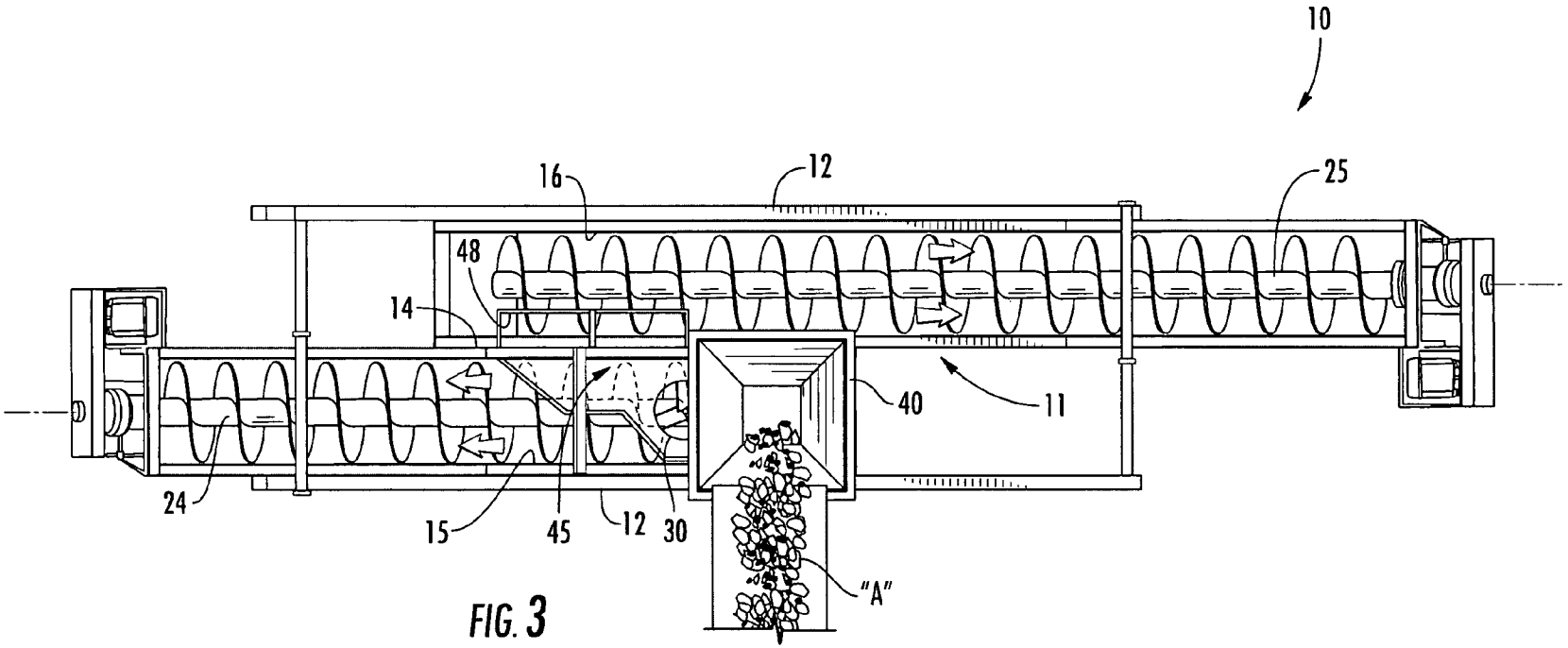
FIG. 3 is a top plan view of the exemplary fluid classifier.
Figure 4:
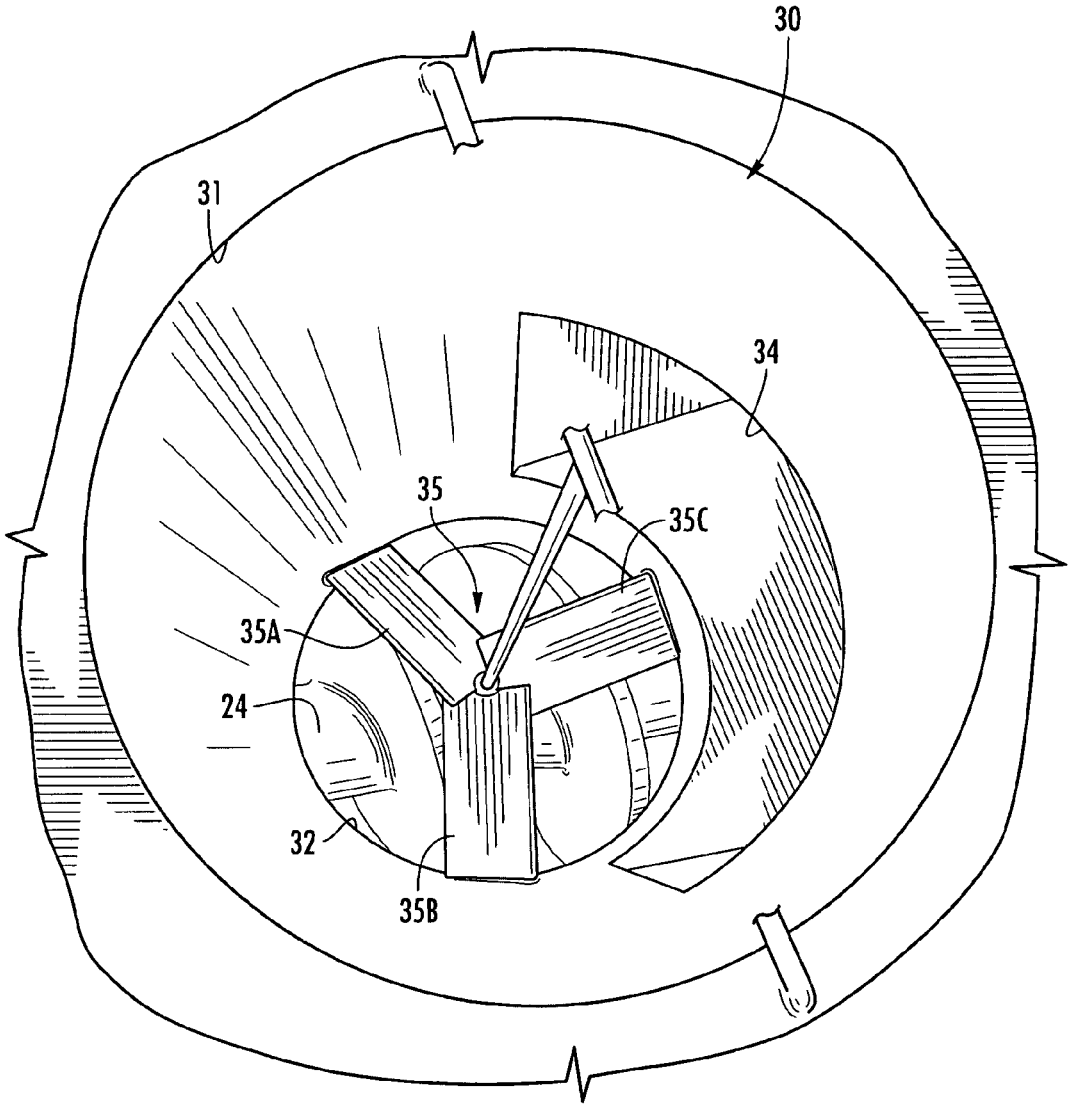
FIG. 4 is an enlarged fragmentary view showing the rising current chamber inside the fluid classifier.

As shown in FIGS. 1, 2, and 3, the exemplary classifier 10 comprises a classifier tank 11 defined by exterior walls 12 designed for holding the liquid medium (e.g., water). An intermediate wall 14, best shown in FIG. 3, divides the classifier tank 11 into adjacent sink fraction and float fraction chambers 15, 16. A fluid inlet pipe 18 communicates with the sink fraction chamber 15 and a hydraulic pump (not shown) to fill the classifier 10 with water. Discharge lines 21 communicate with the float fraction chamber 16, and serve to manage water levels within the classifier tank 11 during operation of the fluid classifier 10. The classifier tank 11 may also have drain valves 22A, 22B at each of the sink fraction and float fraction chambers 15, 16 for rapid draining. Aggregates collecting in the sink fraction and float fraction chambers 15, 16 are removed from the classifier tank 11 using respective, upwardly angled screw conveyors 24, 25.

Referring to FIGS. 3, 4, 5, and 6, a cylindrical rising current column 30 is vertically mounted within the sink fraction chamber 15 of the classifier tank 11, and extends below a surface of the water towards the screw conveyor 24. The rising current column 30 has open upper and lower ends 31, 32, and defines an intermediate aggregate entry 34 for receiving dry material aggregate "A" into the classifier tank 11 for processing. A flow control device 35 may be operatively positioned at the open lower end 32 of the rising current column 30 to manipulate the current flow during operation of the fluid classifier 10. In one exemplary embodiment, the flow control device 35 comprises a series of radiating angled blades 35A, 35B, 35C designed for generating an upwardly whirling or vortex-like flow of water inside the rising current column 30.

Figure 5:
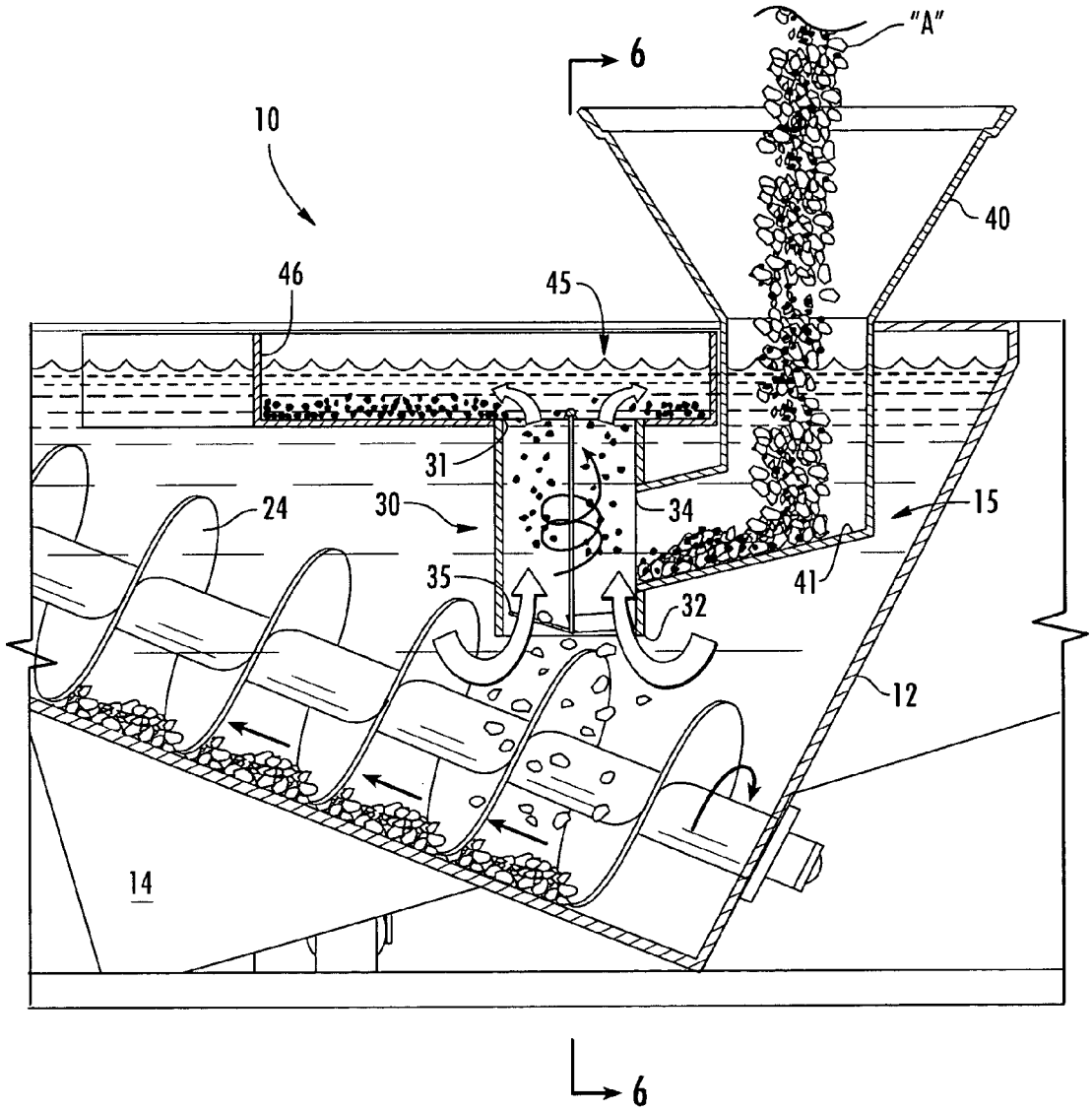
FIG. 5 is a fragmentary, cross-sectional view of the fluid classifier taken substantially along line 5-5 of FIG. 6.

In the exemplary classifier 10, the dry material aggregate "A" is deposited into an elevated hopper 40 and gravity fed through an internal chute 41, best shown in FIG. 5, into the rising current column 30 via the aggregate entry 34. As material aggregate enters the relatively turbulent water of the rising current column 30, the denser aggregate fraction (or "waste rock") sinks downwardly and exits the column 30 through the open lower end 32 where it is immediately collected and removed from the classifier tank 11 by the screw conveyor 24, as shown in FIG. 5. The waste rock "R" exits the fluid classifier 10 through the discharge chute 42 shown in FIGS. 1 and 2, and is stockpiled for subsequent removal.

Figure 6:
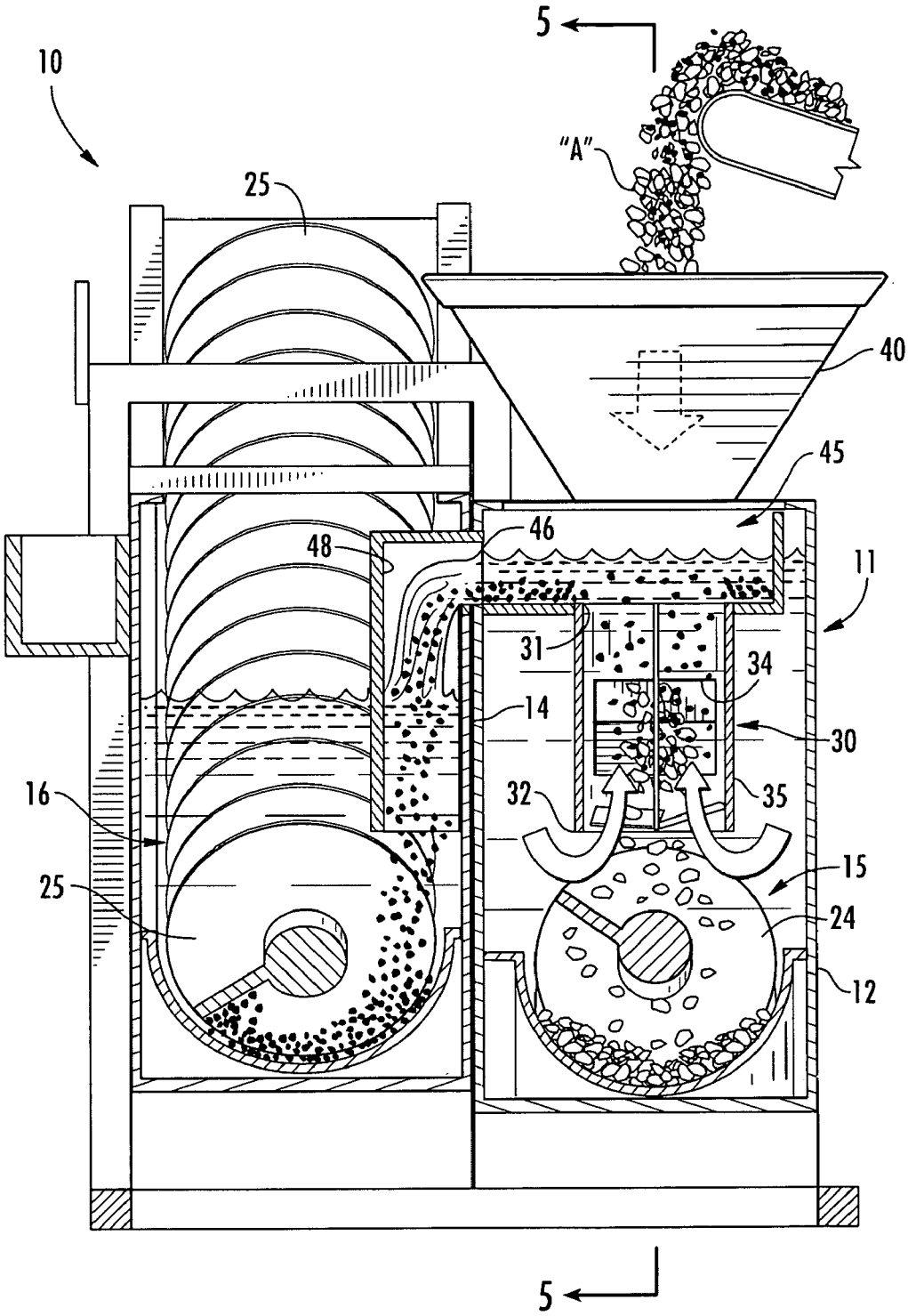
FIG. 6 is a fragmentary, cross-sectional view of the fluid classifier taken substantially along line 6-6 of FIG. 5.

As best illustrated in FIGS. 5 and 6, the less dense aggregate fraction (e.g., coal fines "C") floats upwardly through the open upper end 31 of the rising current column 30, and passes outwardly into a relatively tranquil float fraction reservoir 45 located above the sink fraction chamber 15. From the float fraction reservoir 45, the rising water spills outwardly through a slotted opening 46 a falls downstream through an overflow passage 48 into the float fraction chamber 16. The exemplary overflow passage 48 is defined by a substantially rectangular conduit adjacent the intermediate wall 14, and extending downwardly into the float fraction chamber 16 towards the screw conveyor 25. As best shown in FIG. 6, from the overflow passage 48, the floating aggregate fraction "C" entrained in the water is immediately captured by the screw conveyor 25 and moved upwardly and outwardly from the classifier tank 11 through discharge chute 52 (See FIGS. 1 and 2). The upwardly-angled orientation of the screw conveyors 24, 25 substantially de-waters the aggregate fractions "R" and "C" prior to their exiting the fluid classifier 10 through respective discharge chutes 42, 52.

As indicated above, the fluid classifier may utilize an alternative liquid medium with a higher specific gravity in order to float and separate heavier aggregate fractions. Additionally, by adjusting the fluid level of the sink fraction chamber, the vortex-like flow within the rising current chamber may be either increased or decreased, thereby controlling the relative weight of aggregate fraction separated from the raw material aggregate deposited into the classifier tank.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. A hindered-settling fluid classifier adapted for processing material aggregate in a liquid medium, said fluid classifier comprising:

a classifier tank defined by walls designed for holding the liquid medium, and comprising a sink fraction chamber and a float fraction chamber, and a fluid inlet and a fluid outlet;

an elongated rising current column vertically mounted within said sink fraction chamber, and adapted for extending below a surface of the liquid medium held therein, said rising current column having open upper and lower ends, and defining an aggregate entry between its upper and lower ends for receiving material aggregate into said classifier tank, whereby a portion of the material aggregate entering said rising current column is carried upwardly in an upwardly directed flow of liquid medium within said rising current column;

a float fraction reservoir above said sink fraction chamber, and communicating with the open upper end of said rising current column;

an overflow passage communicating with said float fraction reservoir and adapted for directing the liquid medium outwardly from said reservoir and into said float fraction chamber;

means for removing an aggregate float fraction entrained in the liquid medium and collecting inside the float fraction chamber; and means for removing an aggregate sink fraction collecting inside the sink fraction chamber.

2. A hindered-settling fluid classifier according to claim 1, and comprising an elevated aggregate hopper and deposit chute adapted for gravity feeding dry material aggregate into said classifier tank through the aggregate entry formed with said rising current column.

3. A hindered-settling fluid classifier according to claim 1, and comprising a flow control device located adjacent the open lower end of said rising current column.

4. A hindered-settling fluid classifier according to claim 3, wherein said flow control device comprises a series of radiating angled blades adapted for generating an upwardly whirling flow of liquid medium inside said rising current column.

5. A hindered-settling fluid classifier according to claim 1, wherein said means for removing the aggregate float fraction comprises an upwardly-angled screw conveyor.

6. A hindered-settling fluid classifier according to claim 1, wherein said means for removing the aggregate sink fraction comprises an upwardly-angled screw conveyor.

7. A hindered-settling fluid classifier according to claim 1, and wherein said fluid outlet comprises a discharge line communicating with said float fraction chamber.

8. A hindered-settling fluid classifier according to claim 1, wherein said fluid inlet communicates with said sink fraction chamber.

9. A hindered-settling fluid classifier according to claim 1, wherein said sink fraction chamber comprises a drain valve.

10. A hindered-settling fluid classifier according to claim 1, wherein said float fraction chamber comprises a drain valve.

11. A hindered-settling fluid classifier adapted for processing material aggregate in a liquid medium, said fluid classifier comprising:

a classifier tank defined by walls designed for holding the liquid medium, and comprising a sink fraction chamber and a float fraction chamber, and a fluid inlet and a fluid outlet;

an elongated rising current column vertically mounted within said sink fraction chamber, and adapted for extending below a surface of the liquid medium held therein, said rising current column having open upper and lower ends, and defining an aggregate entry between its upper and lower ends for receiving material aggregate into said classifier tank, whereby a portion of the material aggregate entering said rising current column is carried upwardly in an upwardly directed flow of liquid medium within said rising current column;

an overflow passage communicating with the open upper end of said rising current column for directing the liquid medium flowing outwardly from said sink fraction chamber into said float fraction chamber;

a first screw conveyor for removing an aggregate float fraction entrained in the liquid medium and collecting inside the float fraction chamber; and a second screw conveyor for removing an aggregate sink fraction collecting inside the sink fraction chamber.

12. A hindered-settling fluid classifier according to claim 11, and comprising an elevated aggregate hopper and deposit chute adapted for gravity feeding dry material aggregate into said classifier tank through the aggregate entry formed with said rising current column.

13. A hindered-settling fluid classifier according to claim 11, and comprising a flow control device located adjacent the open lower end of said rising current column.

14. A hindered-settling fluid classifier according to claim 13, wherein said flow control device comprises a series of radiating angled blades adapted for generating an upwardly whirling flow of liquid medium inside said rising current column.

15. A hindered-settling fluid classifier according to claim 11, and wherein said fluid outlet comprises a discharge line communicating with said float fraction chamber.

16. A hindered-settling fluid classifier according to claim 11, wherein said fluid inlet communicates with said sink fraction chamber.

17. A hindered-settling fluid classifier according to claim 11, wherein said sink fraction chamber comprises a drain valve.

18. A hindered-settling fluid classifier according to claim 11, wherein said float fraction chamber comprises a drain valve.

19. A method for classifying material aggregate in a liquid medium, said method comprising:

depositing dry material aggregate into a classifier tank of a hindered-settling fluid classifier, the classifier tank comprising a sink fraction chamber and a float fraction chamber;

feeding the dry material aggregate through a deposit chute and into a rising current column vertically mounted within the sink fraction chamber;

generating an upwardly whirling flow of liquid medium inside the rising current column, the liquid medium comprising an entrained fraction of material aggregate;

directing the liquid medium exiting the rising current column into the float fraction chamber;

removing from the classifier tank an aggregate float fraction entrained in the liquid medium and collecting in the float fraction chamber; and removing from the classifier tank an aggregate sink fraction collecting in the sink fraction chamber.

20. A method according to claim 19, wherein directing the liquid medium outwardly from the rising current column comprises temporarily holding the liquid medium in a float fraction reservoir prior to overflow into the float fraction chamber.

* * * * *